US009962928B2

(12) United States Patent
Sakurada et al.

(10) Patent No.: US 9,962,928 B2
(45) Date of Patent: May 8, 2018

(54) PRINTING APPARATUS AND PRINTING METHOD

(71) Applicant: SEIKO EPSON CORPORATION, Tokyo (JP)

(72) Inventors: Kazuaki Sakurada, Nagano (JP); Takamitsu Kondo, Nagano (JP); Seigo Momose, Nagano (JP); Akira Yamada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/466,992

(22) Filed: Mar. 23, 2017

(65) Prior Publication Data

US 2017/0190172 A1 Jul. 6, 2017

Related U.S. Application Data

(63) Continuation of application No. 15/055,693, filed on Feb. 29, 2016, now Pat. No. 9,636,933.

(30) Foreign Application Priority Data

Mar. 30, 2015 (JP) ..... 2015-068259

(51) Int. Cl.
*B41J 2/045* (2006.01)
*B41J 2/21* (2006.01)
*B41J 13/00* (2006.01)

(52) U.S. Cl.
CPC ..... *B41J 2/04508* (2013.01); *B41J 2/04586* (2013.01); *B41J 2/2132* (2013.01); *B41J 13/0009* (2013.01)

(58) Field of Classification Search
CPC .. B41J 2/04508; B41J 2/04586; B41J 2/2132; B41J 13/0009

(Continued)

(56) References Cited

U.S. PATENT DOCUMENTS

2002/0167569 A1 11/2002 Hosono et al.
2004/0183846 A1* 9/2004 Kunihiro ..... B41J 11/008 347/14

(Continued)

FOREIGN PATENT DOCUMENTS

JP 2006-239866 A 9/2006
JP 2007-030503 A 2/2007

OTHER PUBLICATIONS

The Extended European Search Report for the corresponding European Application No. 16161527.3 dated Aug. 26, 2016.

*Primary Examiner* — Huan Tran
*Assistant Examiner* — Alexander D Shenderov

(57) ABSTRACT

A printing apparatus includes a transport section, a printing section, and a control section. The printing section is configured to move in an intersecting direction intersecting a transport direction of a recording medium. The printing section includes a plurality of nozzles that are configured to perform printing by discharging an ink onto the recording medium. The control section is configured to control the transport section and the printing section. The printing section includes a first nozzle row and a second nozzle row, the first and second nozzle rows form an overlapping section in which the first and second nozzle rows overlap each other as viewed in the intersecting direction. The control section is configured to control a plurality of adjacent nozzles among the first nozzle row and the second nozzle row, which are in the vicinity of the overlapping section, not to discharge the ink.

7 Claims, 10 Drawing Sheets

(58) Field of Classification Search
USPC ..... 347/14
See application file for complete search history.

(56) References Cited

U.S. PATENT DOCUMENTS

| | | | | |
|---|---|---|---|---|
| 2005/0122354 | A1 | 6/2005 | Yamane et al. | |
| 2006/0192798 | A1 | 8/2006 | Kuki et al. | |
| 2013/0050315 | A1 | 2/2013 | Kusakari | |
| 2014/0028748 | A1* | 1/2014 | Hudd | B41J 2/15 347/12 |

* cited by examiner n$^{th}$ TIME n+1$^{th}$ TIME n+2$^{th}$ TIME n+3$^{th}$ TIME n^th TIME n+1^th TIME n+2^th TIME n+3^th TIME
1
6A
6B
6C
61a
62a
63a
64a
65a
66a
67a
68a
61b
62b
63b
64b
65b
66b
67b
68b
100a
100b
W
x
y
z n th TIME n+1 th TIME n+2 th TIME n+3 th TIME
1
6A
6B
6C
61a
62a
63a
64a
65a
66a
67a
68a
61b
62b
63b
64b
65b
66b
67b
68b
100a
100b
W
x
y
z 1
6B
68a
67a
66a
65a
64a
63a
62a
61a
61b
62b
63b
64b
65b
66b
67b
68b
L2
6C
6A nth TIME
100b
100a
L1
P1
W n+1th TIME
100b
100b
100a
P2
W n+2th TIME
100b
100a
P1
W n+3th TIME
100b
100a
P2
W
x
y
z 200
100a
100b
W
$L_3$
300
x
y
z

PRINTING APPARATUS AND PRINTING METHOD

CROSS-REFERENCE TO RELATED APPLICATIONS

This application is a continuation application of U.S. patent application Ser. No. 15/055,693, filed on Feb. 29, 2016. This application claims priority to Japanese Patent Application No. 2015-068259, filed Mar. 30, 2015. The entire disclosures of U.S. patent application Ser. No. 15/055,693 and Japanese Patent Application No. 2015-068259 are expressly incorporated by reference herein.

BACKGROUND

1. Technical Field

The present invention relates to a printing apparatus and a printing method.

2. Related Art

Printing apparatuses that print by applying ink onto a recording medium have been used in the related art (for example, refer to JP-A-2006-239866). The printing apparatus disclosed in JP-A-2006-239866 is provided with a transport unit that transports a recording medium, and multiple nozzles (ink jet heads) that discharge ink onto the recording medium, which is transported, while moving in a direction that intersects a transport direction of the recording medium.

Generally, multiple nozzles are disposed in a row form of two rows as a first nozzle row and a second nozzle row. The first nozzle row and the second nozzle row are disposed adjacent to and parallel to one another along the transport direction of the recording medium. In addition, the first nozzle row and the second nozzle row are disposed so that the end sections of the first nozzle row and the second nozzle row overlap when viewed from a direction that intersects with the transport direction of the recording medium.

In such a printing apparatus, printing is generally performed in the manner that is shown in FIGS. 3A to 3D. Firstly, all of the nozzles of the first nozzle row and the second nozzle row discharge the ink (an $n^{th}$ time). Further, the ink jet heads are moved in a direction that intersects the transport direction of the recording medium by an amount that is equivalent to a single nozzle row, and the ink is discharged (an $n+1^{th}$ time). At this time, nozzles of an overlapping section, in which the first printing row and the second printing row overlap, do not discharge the ink. Printing is performed as shown in FIGS. 4B to 4E as a result of the nozzles of the overlapping section repeating the discharge and non-discharge of the ink in this manner.

Given that, in a case in which the distance between each nozzle and the recording medium is comparatively large, it is easy for a phenomenon in which the ink discharged from each nozzle does not land directly therebelow, that is, in which landing positions are shifted, to occur. In particular, there is a tendency for the shifting of the landing positions to be significant for the ink discharged from nozzles positioned in the end sections of the first nozzle row and the second nozzle row (refer to FIGS. 5A and 5B). Therefore, the shifting of the landing positions is significant for the ink discharged from the nozzles of the overlapping section. As a result of this, it is likely that a deterioration in the image quality of a formed image on the recording medium will occur.

SUMMARY

An advantage of some aspects of the invention is to provide a printing apparatus and a printing method that can prevent a deterioration in the image quality of an obtained image.

The advantage can be achieved by the following invention.

According to one aspect of the invention, a printing apparatus includes a transport section, a printing section, and a control section. The transport section is configured to transport a recording medium in a transport direction. The printing section is configured to move in an intersecting direction that intersects the transport direction. The printing section includes a plurality of nozzles that are configured to perform printing by discharging an ink, as liquid droplets, onto the recording medium transported by the transport section. The control section is configured to control the transport section and the printing section. The printing section includes a first nozzle row, and a second nozzle row, and the first nozzle row and the second nozzle row form an overlapping section in which the first nozzle row and the second nozzle row overlap each other as viewed in the intersecting direction. The control section is configured to control a plurality of adjacent nozzles among the first nozzle row and the second nozzle row, which are in the vicinity of the overlapping section, not to discharge the ink.

According to the aspect of the invention, the control section is further configured to control a plurality of overlapping nozzles, which are positioned in the overlapping section, not to discharge the ink.

According to the aspect of the invention, the control section is configured to control the adjacent nozzles and the overlapping nozzles to discharge the ink during an Nth discharge from the first nozzle row and the second nozzle row, the N is an integer of one or more, and the control section is configured to control the adjacent nozzles and the overlapping nozzles not to discharge the ink during an N+1 discharge from the first nozzle row and second nozzle row.

According to the aspect of the invention, the adjacent nozzles which are controlled not to discharge the ink are established in advance before the printing is performed on the recording medium.

According to the aspect of the invention, the adjacent nozzles which are controlled not to discharge the ink are established depending on a separation distance between each nozzle and the recording medium that is directly below each nozzle.

According to the aspect of the invention, the liquid droplets which the first nozzle row and the second nozzle row discharge, are the same color.

According to another aspect of the invention, a printing method includes, transporting a recording medium in a transport direction, moving a printing section in an intersecting direction that intersects the transport direction, printing by discharging an ink, as liquid droplets, onto the recording medium from the printing section including a plurality of nozzles while the recording medium is transported, and controlling the transporting and the printing. The printing section includes a first nozzle row, and a second nozzle row, and the first nozzle row and the second nozzle row form an overlapping section in which the first nozzle row and the second nozzle row overlap each other as viewed in the intersecting direction. The controlling includes controlling a plurality of adjacent nozzles among the first nozzle row and the second nozzle row, which are in the vicinity of the overlapping section, not to discharge the ink.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a printing apparatus and a printing method of aspects of the invention will be described in detail on the basis of preferred embodiments that are shown in the appended drawings.

First Embodiment

Figure 1:
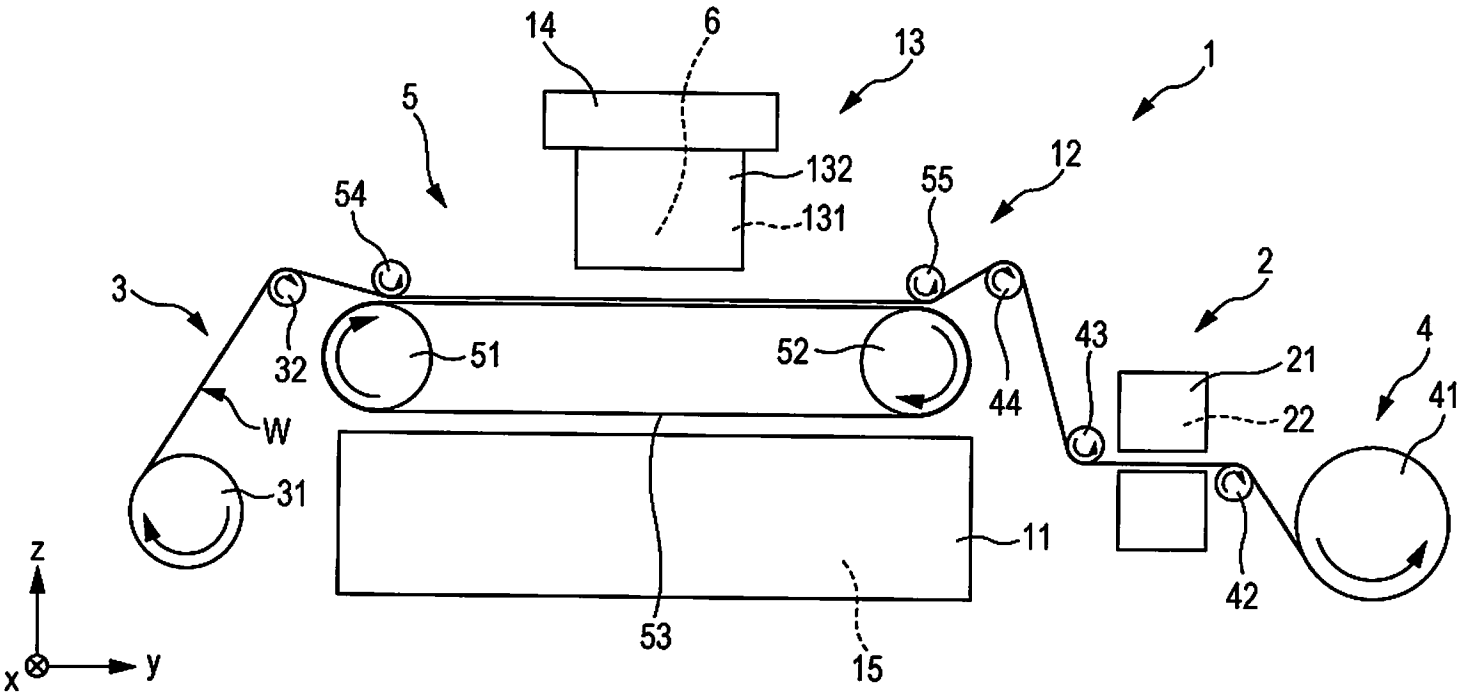
FIG. 1 is a side view that schematically shows a first embodiment of a printing apparatus of the invention.
Figure 2:
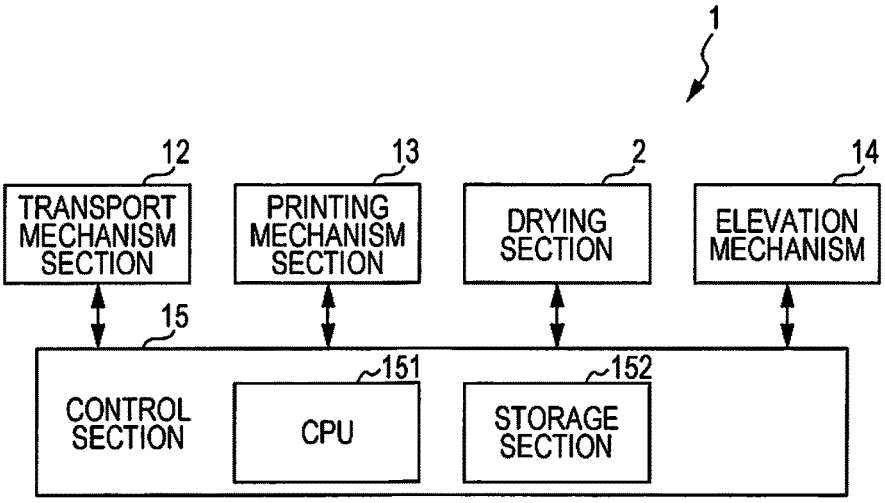
FIG. 2 is a block diagram of the printing apparatus that is shown in FIG. 1.
Figures 4A, 4B, 4C, 4D, 4E:
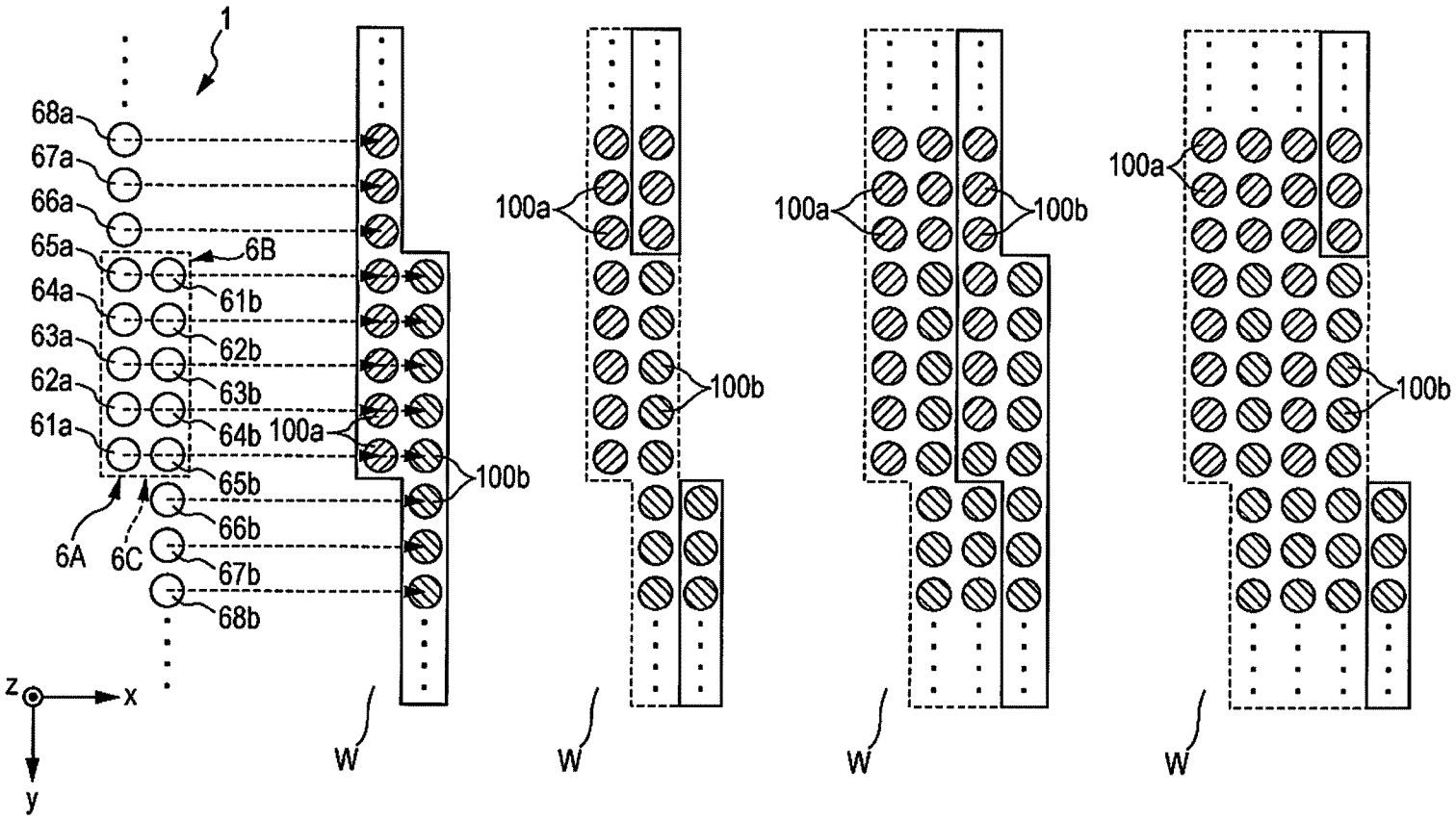
FIG. 4A is a view for describing an arrangement of nozzles.
FIGS. 4B to 4E are plan views of a recording medium that show images of a case in which positional shift does not arise.
Figures 5A, 5B, 5C, 5D, 5E:
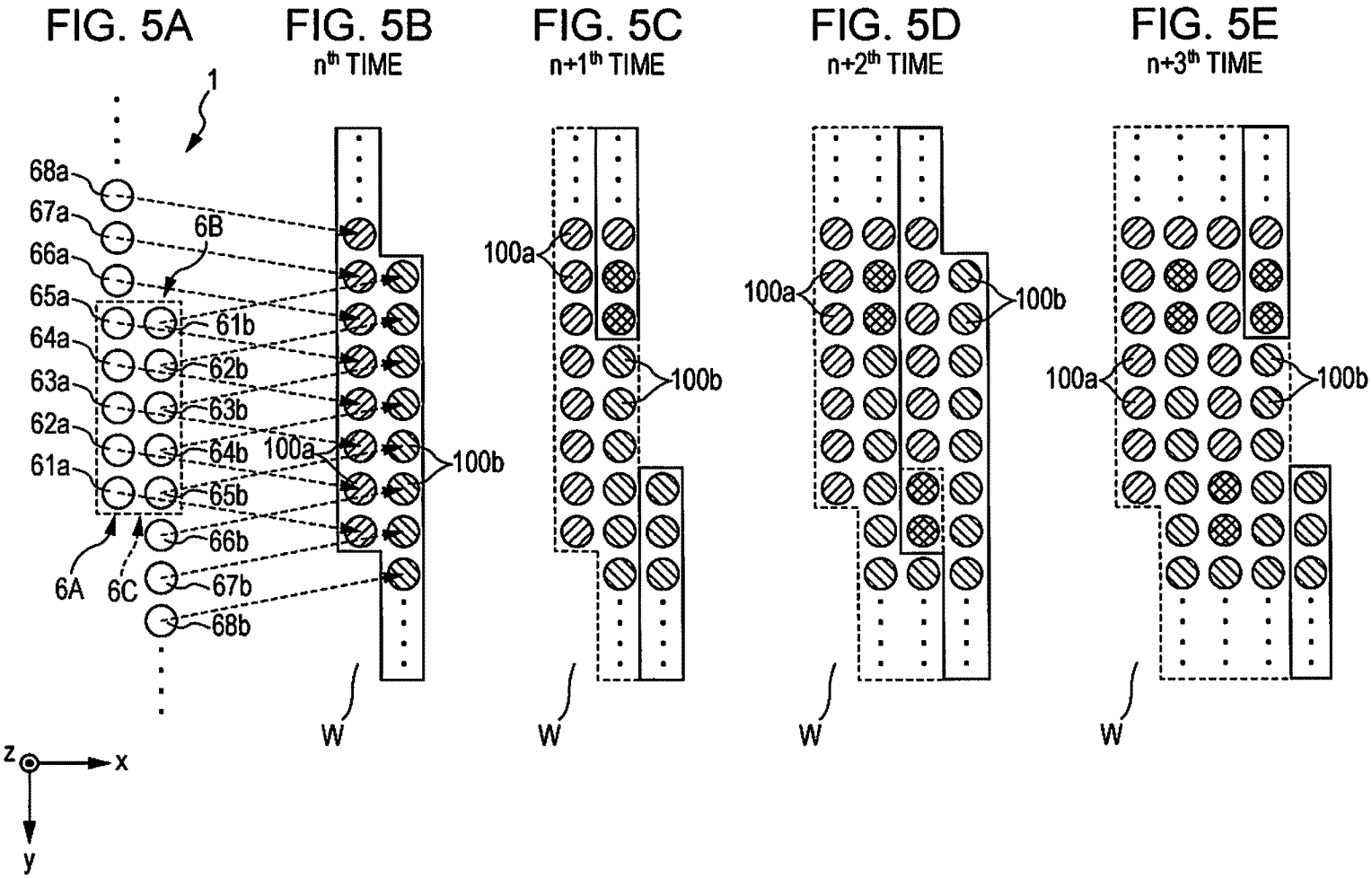
FIG. 5A is a view for describing an arrangement of nozzles.
FIGS. 5B to 5E are plan views of a recording medium that show images that are printed by a printing method of the related art in a case in which positional shift arises.
Figures 6A, 6B, 6C, 6D, 6E:
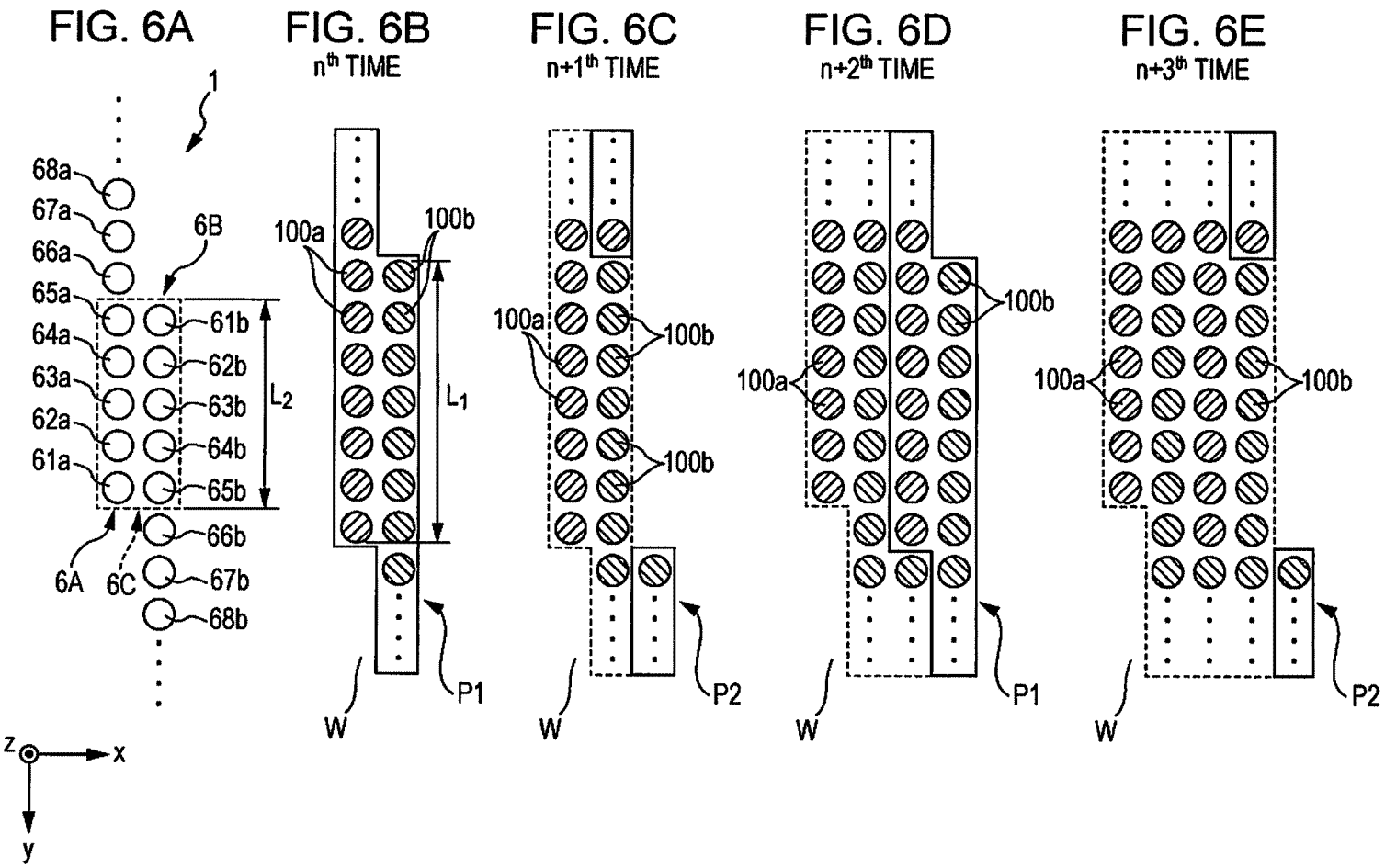
FIG. 6A is a view for describing an arrangement of nozzles.
FIGS. 6B to 6E are plan views of a recording medium that show images that are printed by a printing method of the invention.
Figure 7C:
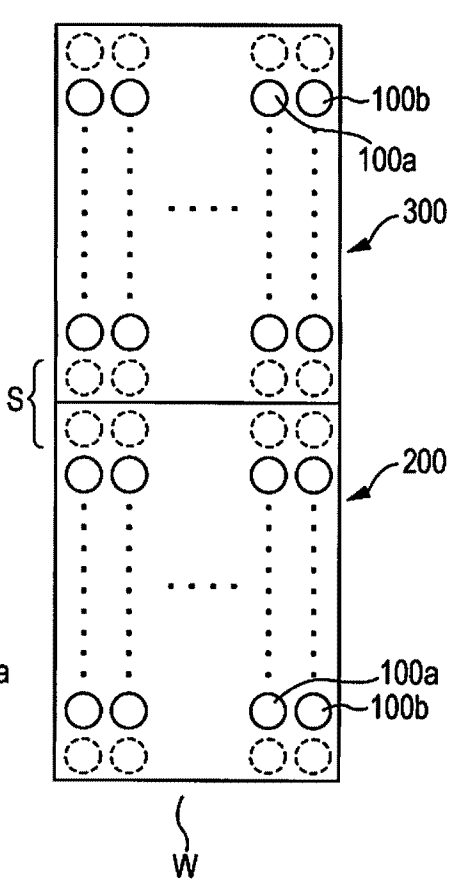
FIGS. 7A to 7C are plan views that show an action method of a transport section of the related art.
Figure 7B:
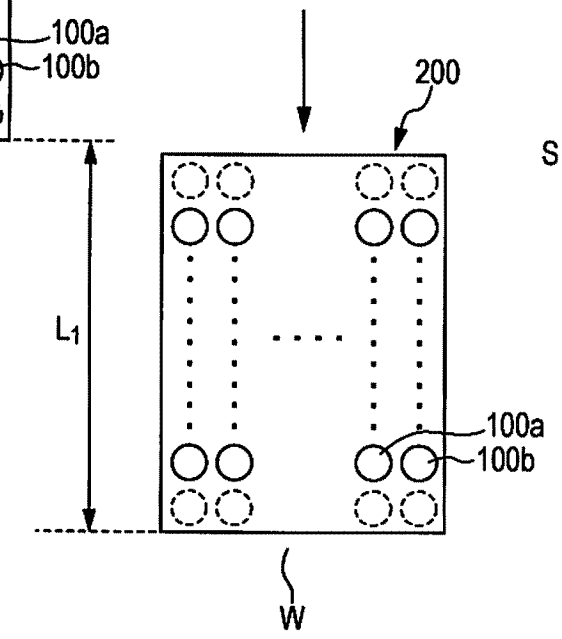
Figure 7A:
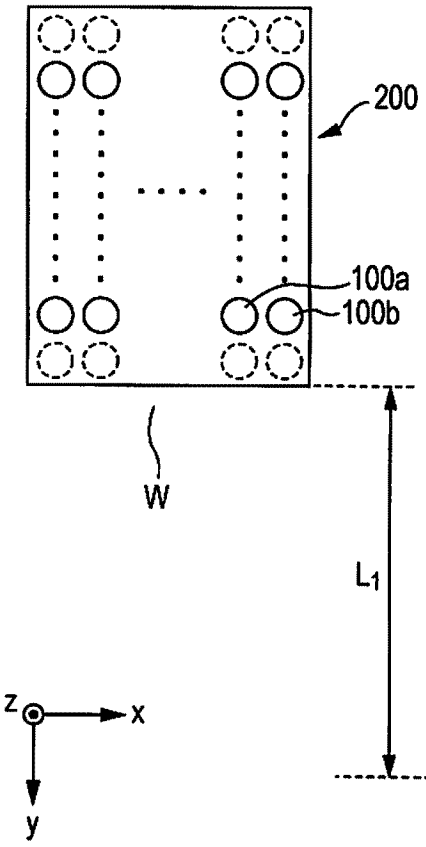
Figures 8A, 8B, 8C:
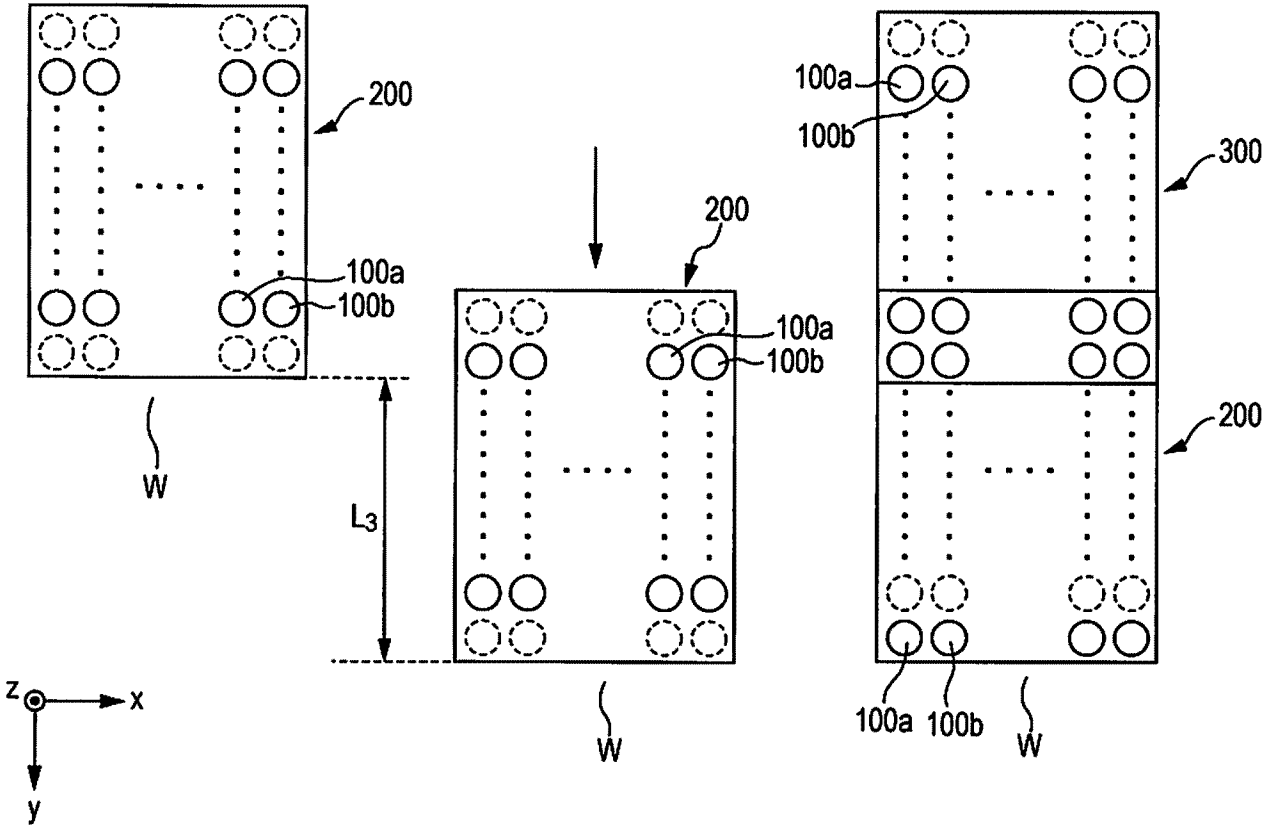
FIGS. 8A to 8C are plan views that show an action method of a transport section in the printing method of the invention.
Figure 9:
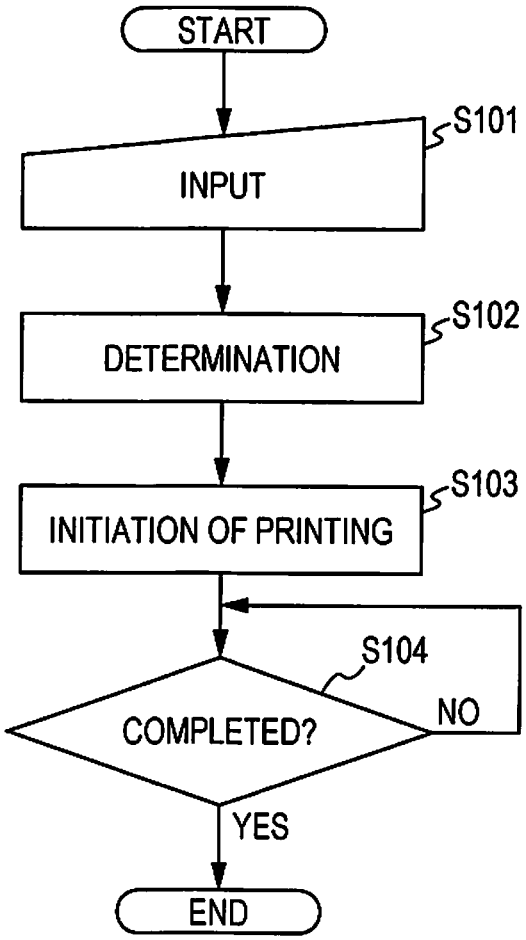
FIG. 9 is a flowchart that describes a control program of the printing apparatus of the invention.

FIG. 1 is a side view that schematically shows a first embodiment of a printing apparatus of the invention. FIG. 2 is a block diagram of the printing apparatus that is shown in FIG. 1. FIGS. 3A to 3D are views that show movement of a printing section of the printing apparatus that is shown in FIG. 1 in time series. FIG. 4A is a view for describing an arrangement of nozzles, and FIGS. 4B to 4E are plan views of a recording medium that show images of a case in which positional shift does not arise. FIG. 5A is a view for describing an arrangement of nozzles, and FIGS. 5B to 5E are plan views of a recording medium that show images that are printed by a printing method of the related art in a case in which positional shift arises. FIG. 6A is a view for describing an arrangement of nozzles, and FIGS. 6B to 6E are plan views of a recording medium that show images that are printed by a printing method of the invention. FIGS. 7A to 7C are plan views that show an action method of a transport section of the related art. FIGS. 8A to 8C are plan views that show an action method of a transport section in the printing method of the invention. FIG. 9 is a flowchart that describes a control program of the printing apparatus of the invention.

Additionally, hereinafter, for the convenience of description, in FIGS. 1 and 3A to 8C, an x axis, a y axis, and a z axis are shown as three axes, which mutually intersect one another. The x axis is an axis along a direction (a width (depth) direction of the printing apparatus) in the horizontal direction, the y axis is an axis along direction (a longitudinal direction of the printing apparatus), which is a horizontal direction, and is perpendicular to the x axis, and the z axis is an axis along a vertical direction (an up-down direction). In addition, a leading end section of each arrow that is shown in the drawings is set as a "positive side (a + side)", and a base end side is set as a "negative side (a − side)". In addition, the upper sides in FIGS. 1 and 3A to 8C will be referred to as the "top (upper regions)", and lower sides thereof will be referred to as the "bottom (lower regions)".

As shown in FIGS. 1 and 2, a printing apparatus 1 executes a printing method of the invention, and is provided with a machine platform 11, a transport mechanism section (a transport section) 12 that transports work W, as a recording medium, a printing mechanism section (a recording section) 13 that carries out printing by applying an ink 100 to the work W, a drying section 2 that dries the ink 100 on the work W and an elevation mechanism 14.

In the present embodiment, a direction that is orthogonal to a transport direction, in which the work W is transported, is an x axis direction, a direction that is parallel to the transport direction is a y axis direction, and a direction that is orthogonal to the x axis direction and the y axis direction is a z axis direction.

The transport mechanism section 12 is provided with a reel-out device 3 that reels out the longitudinal work W, which is wound around in roll shape, a winding device 4 that winds the work W, on which printing is finished, a support device 5 that is installed on the machine platform 11, and that supports the work W during printing.

The reel-out device 3 is installed on an upstream side of the machine platform 11 in a feed direction of the work W (the y axis direction). The reel-out device 3 includes a feed-out roller (a reel-out reel) 31 around which the work W is wound in roll shape, and that feeds the work W out, and a tensioner 32 that generates tension in the work W between the feed-out roller 31 and the support device 5. A motor (not illustrated in the drawings) is connected to the feed-out roller 31, and the feed-out roller 31 can rotate as a result of the action of the motor.

Additionally, as the work W, it is possible to use a thin film recording medium that has an ink-absorbing property, or a thin film recording medium that has a non-ink-absorbing property. In a case of the former, for example, examples include normal paper, wood free paper, special purpose paper for ink jet recording such as glossy paper, and in addition to the above, a woven fabric, or the like. In a case of the latter, for example, examples include a plastic film on which a surface treatment for ink jet printing has not been performed (that is, on which an ink-absorbing layer is not formed), a recording medium in which a plastic is coated onto, or in which a plastic film is bonded to a base material such as a paper. The corresponding plastic is not particularly limited, and for example, examples thereof include polyvinyl chloride, polyethylene terephthalate, polycarbonate, polystyrene, polyurethane, polyethylene, and polypropylene.

The winding device 4 is installed on a downstream side of the machine platform 11 in a feed direction of the work W (the y axis direction) with respect to the reel-out device 3. The winding device 4 includes a winding roller (a winding reel) 41 onto which the work W is wound in roll shape, and tensioners 42, 43 and 44 that generate tension in the work W between the winding roller 41 and the support device 5. A motor (not illustrated in the drawings) is connected to the winding roller 41, and the winding roller 41 can rotate as a result of the action of the motor. The tensioners 42, 43 and 44 are respectively disposed in this order at intervals in a direction that becomes separated from the winding roller 41.

The support device 5 is disposed between the reel-out device 3 and the winding device 4. The support device 5 includes a main driving roller 51 and a driven roller 52, which are disposed separated from one another in the y axis direction, an endless belt 53, which is stretched between the main driving roller 51 and the driven roller 52, and which supports the work W on an upper surface (a support surface) thereof, and tensioners 54 and 55 that generate tension in the work W between the main driving roller 51 and the driven roller 52.

A motor (not illustrated in the drawings) is connected to the main driving roller 51, and the main driving roller 51 can rotate as a result of the action of the motor. In addition, a rotational force of the main driving roller 51 is transmitted to the driven roller 52 via the endless belt 53, and the driven roller 52 can rotate in an interlocked manner with the main driving roller 51.

The endless belt 53 is a belt on which an adhesive layer, which has an adhesive property, is formed on a surface of a front side thereof. A portion of the work W is adhered to and fixed to the adhesive layer, and the work W is transported in the y axis direction. Further, printing is carried out on the work W during the transport. In addition, after the printing has been carried out, the work W peels away from the endless belt 53.

In the same manner as the main driving roller 51 and the driven roller 52, the tensioners 54 and 55 are disposed separated from one another in the y axis direction.

It is possible to interpose the work W between the tensioner 54 and the main driving roller 51 on the endless belt 53, and it is possible to interpose the work W between the tensioner 55 and the driven roller 52 on the endless belt 53. As a result of this, the work W, in which tension is generated by the tensioners 54 and 55, is fixed to the endless belt 53 and transported in a state in which the tension is generated. As a result of such a state, in the work W, for example, the generation of wrinkles, or the like, during transport is reduced, and accordingly, in a case in which printing is carried out, and therefore, the printing is accurate and high-quality.

The printing mechanism section 13 is provided with a carriage unit 132, which has a plurality of ink jet heads 131 that perform recording through printing by discharging the ink 100 onto the work W, and an X axis table (not illustrated in the drawing) that supports the carriage unit 132 in a manner in which the carriage unit 132 is capable of moving in the x axis direction. Each ink jet head 131 is respectively provided with, for example, a head main body, in which an internal head flow channel, an inner section of which is filled with the ink 100, is formed, and multiple nozzle groups 6, which have an opening.

A piezo piezoelectric element (a piezoelectric body) is configured in the head main body to correspond to each discharge nozzle, and when a voltage is applied to a piezo piezoelectric element 135, the ink 100 is discharged from a nozzle group 6 as liquid droplets.

Additionally, in a state in which the ink 100 is not being discharged, the ink jet heads 131 stand by in a position (a stand-by position) that is shifted from the work W (the endless belt 53) when viewed from the z axis direction.

In the printing apparatus 1, the work W, which is reeled out by the reel-out device 3, is intermittently fed (sub-scanned) in the y axis direction in a fixed state of being adhered to and fixed to the endless belt 53, and the ink 100 is discharged from the nozzle groups 6 onto the work W in the fixed state, while the carriage unit 132 is reciprocated (main scanned) in the x axis direction. It is possible to perform the above-mentioned actions until printing is completed, and an image pattern is formed on the work W. Additionally, the image pattern may be an image pattern that results from polychromatic printing (color printing), or may be an image pattern that results from monochromatic printing.

The ink 100 contains a dye or a pigment, as a coloring agent, in water, as a solvent, and for example, there are four colors of cyan (C), magenta (M), yellow (Y) and black (K). Further, the ink 100 of each color is respectively discharged from the ink jet heads 131.

The elevation mechanism 14, which is shown in FIGS. 1 and 2 can adjust the height of the nozzle groups 6. The elevation mechanism 14 can, for example, be set to a configuration that includes a motor, a ball screw and a linear guide. In addition, the motor is equipped with an encoder. It is possible to detect the height of the ink jet head 131 on the basis of a rotational amount that is detected by the encoder. Such an elevation mechanism 14 is also electrically connected to a control section 15.

In this manner, it is possible to change the separation distance G between the nozzle groups 6 and the work W using the elevation mechanism 14. Accordingly, it is possible to perform favorable printing depending on a quality of the material of the work W.

As shown in FIG. 1, the drying section 2 is disposed between the support device 5 and the winding roller 41 of the winding device 4, which is on a downstream side of the printing mechanism section 13 in the transport direction of the work W.

The drying section 2 includes a chamber 21, and a coil 22, which is disposed inside the chamber 21. The coil 22 is, for example, configured by a nichrome wire, and is a heating element that heats as a result of power being supplied thereto. Further, it is possible to dry the ink 100 on the work W that is passing through the chamber 21 as a result of heat that is generated by the coil 22.

As shown in FIG. 2, the control section (an adjustment section) 15 is electrically connected to the drying section 2, the transport mechanism section 12, the printing mechanism section 13 and the elevation mechanism 14, and has a function of respectively controlling the actions of the above-mentioned components. In addition, the control section 15 includes a CPU (Central Processing Unit) 151, and a storage section 152.

The CPU 151 executes programs for various processes such as a printing process such as that mentioned above.

The storage section 152, for example, includes EEPROM (Electrically Erasable Programmable Read-Only Memory), which is a type of non-volatile semiconductor memory, or the like, and can store various programs, or the like.

Next, the nozzle groups 6 which the printing mechanism section 13 includes will be described. A plurality of the nozzle groups 6 are provided for each color of the ink 100, and since the nozzle groups 6 have the same configuration (disposition) for each color, hereinafter, black (K) nozzle groups 6 will be described as a representative example.

As shown in FIGS. 3A to 3D, 4A, 5A and 6A, in the nozzle groups 6, multiple nozzles are disposed in two rows, and it is possible to split the nozzle groups 6 into a first nozzle row 6A and a second nozzle row 6B. The first nozzle row 6A and the second nozzle row 6B extend in the y axis direction. In addition, the first nozzle row 6A and the second nozzle row 6B are adjacent along the x axis direction, and are lined up in order from a −x axis side.

In addition, the first nozzle row 6A and the second nozzle row 6B are shifted in the y axis direction, and when viewed from the x axis direction, an end section on the −y axis side of the first nozzle row 6A overlaps with an end section on the +y axis side of the second nozzle row 6B.

In the first nozzle row 6A and the second nozzle row 6B that are shown in FIGS. 4A, 5A and 6A, portions thereof are illustrated. In FIG. 4A, in the first nozzle row 6A, the illustrated nozzles are set as nozzles 61*a*, 62*a*, 63*a*, 64*a*, 65*a*, 66*a*, 67*a* and 68*a*, and in the second nozzle row 6B, the illustrated nozzles are set as nozzles 61*b*, 62*b*, 63*b*, 64*b*, 65*b*, 66*b*, 67*b* and 68*b*.

The nozzles 61*a* to 68*a* are lined up in this order from a side of the −y axis direction. The nozzles 61*b* to 68*b* are lined up in this order from a side of the +y axis direction. In addition, the nozzle 61*a* and the nozzle 65*b* overlap in the x axis direction, the nozzles 62*a* and 64*b* overlap in the x axis direction, the nozzles 63*a* and 63*b* overlap in the x axis direction, the nozzles 64*a* and 62*b* overlap in the x axis direction, and the nozzles 65*a* and 61*b* overlap in the x axis direction.

In addition, as shown in FIGS. 4A, 5A and 6A, in the nozzle groups 6, portions that correspond to the nozzles 61*a* to 65*a* and the nozzles 61*b* to 65*b* act as an overlapping section 6C.

In a case in which printing is performed with such nozzle groups 6, printing is carried out on the work W in the following manner.

Figure 3A:
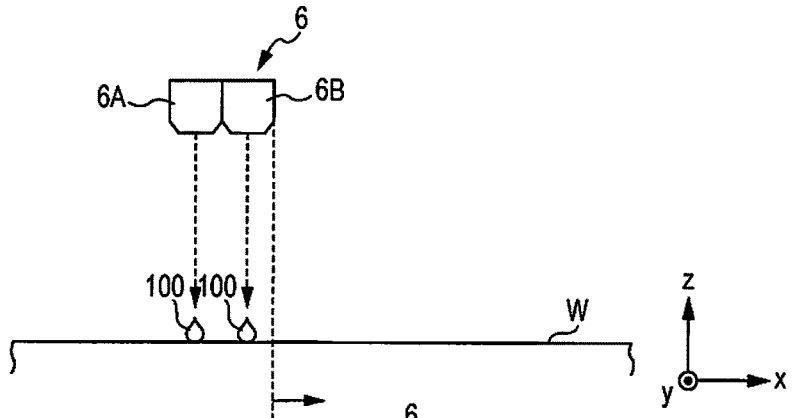
FIGS. 3A to 3D are views that show movement of a printing section of the printing apparatus that is shown in FIG. 1 in time series.
Figure 3B:
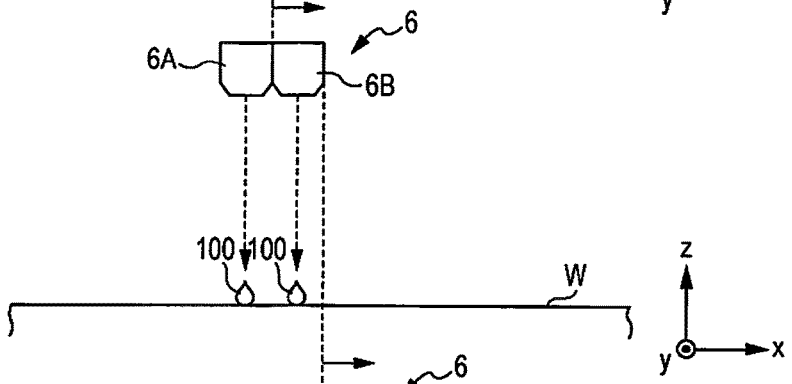
Figure 3C:
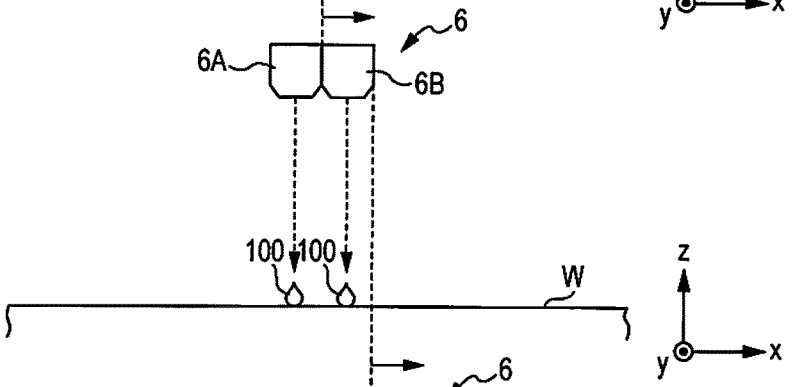
Figure 3D:
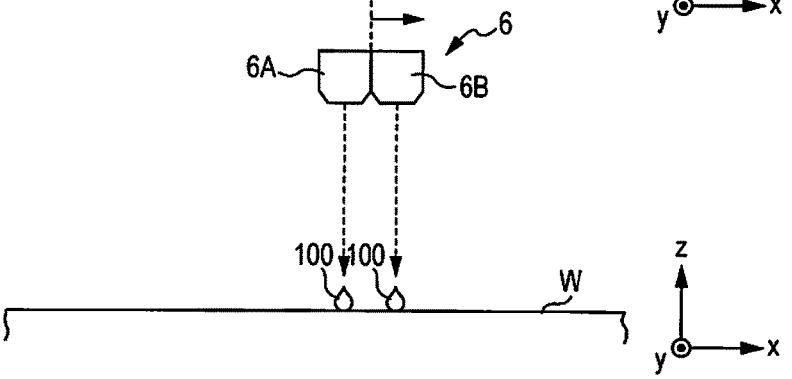

Firstly, the nozzle groups 6 respectively discharge the ink 100 in the positions that are shown in FIG. 3A. This discharge is set as an $n^{th}$ time. Further, the nozzle groups 6 are moved to a position that is shifted in the +x axis direction from the position shown in FIG. 3A by an amount that is equivalent to a single nozzle, and the ink 100 is discharged at the movement destination. This discharge is set as an $n+1^{th}$ time. Such movement and discharge is repeated an $n+2^{th}$ time (refer to FIG. 3C), and an $n+3^{th}$ time (refer to FIG. 3D).

In FIGS. 4B to 4D, first dots (a first printing pattern) 100*a*, at which the ink 100 discharged from the first nozzle row 6A lands on the work W, are shown by hatching diagonally rising to the right, and second dots (a second printing pattern) 100*b*, at which the ink 100 discharged from the second nozzle row 6B lands on the work W, are shown by hatching diagonally rising to the left. In addition, in FIGS. 4B to 4D, a pattern that is formed each time is surrounded by a rectangular border.

As shown in FIGS. 4B to 4D, the printing apparatus 1 has a configuration in which the nozzles 61*a* to 65*a* and nozzles 61*b* to 65*b* of the overlapping section 6C do not discharge the ink 100 at the $n+1^{th}$ time and the $n+3^{th}$ time. As a result of this, in an image that is printed on the work W, a lattice in which the first dots 100*a* and the second dots 100*b* do not overlap is formed. Accordingly, an image that is printed on the work W can prevent a reduction in image quality that is caused by a circumstance in which the first dots 100*a* and the second dots 100*b* overlap. In this manner, in the printing apparatus 1, the discharge of the ink 100 is regulated so as to prevent overlapping of the first dots 100*a* and the second dots 100*b* at the $n+1^{th}$ time and the $n+3^{th}$ time.

In this instance, when the separation distance G is comparatively large, it is easy for a phenomenon in which the ink 100 discharged from the nozzle groups 6 does not land directly therebelow, that is, in which landing positions are shifted, to occur. In particular, there is a tendency for the shifting of the landing positions to be significant for the ink 100 discharged from nozzles positioned in the end sections of the first nozzle row 6A and the second nozzle row 6B, that is, from nozzles of the overlapping section 6C. Therefore, a length $L_1$ of a portions (a third printing region), among the first dots 100*a* and the second dots 100*b*, that are formed by the overlapping section 6C are longer than a length $L_2$ of the overlapping section 6C.

FIGS. 5B to 5D are views for describing the above-mentioned phenomenon. As shown in FIGS. 5A and 5B, the ink 100 discharged from the nozzles 61*a* to 68*a* does not land on the work W directly therebelow, but lands in positions that are shifted to a side in the +y axis direction by an amount that is equivalent to a single nozzle. In addition, as shown in FIGS. 5A and 5B, the ink 100 discharged from the nozzles 61*b* to 68*b* does not land on the work W directly therebelow, but lands in positions that are shifted to a side in the −y axis direction by an amount that is equivalent to a single nozzle. Therefore, as shown in FIGS. 5C and 5E, even if the nozzles 61*a* to 65*a* and the nozzles 61*b* to 65*b* of the overlapping section 6C do not discharge the ink 100 at the $n+1^{th}$ time and the $n+3^{th}$ time, portions of the first dots 100*a* and the second dots 100*b* overlap in an image on the work W.

In FIG. 5C, the second dot 100*b* that is formed by the nozzle 61*b* and 62*b* at the discharge of the $n^{th}$ time, and the first dot 100*a* that is formed by the nozzle 66*a* and 67*a* at the discharge of the $n+1^{th}$ time overlap. In addition, the second dot 100*b* that is formed by the nozzle 61*b* and 62*b* at the discharge of the $n+2^{th}$ time, and the first dot 100*a* that is formed by the nozzle 66*a* and 67*a* at the discharge of the $n+3^{th}$ time overlap. In addition, the first dot 100*a* that is formed by the nozzle 61*a* and 62*a* at the discharge of the $n+2^{th}$ time, and the second dot 100*b* that is formed by the nozzle 66*b* and 67*b* at the discharge of the $n+3^{th}$ time overlap.

As a result of such overlapping of the first dots 100*a* and the second dots 100*b*, a deterioration in image quality is caused in the image on the work W. In such an instance, in the invention, printing is performed in the following manner in order to prevent such defects.

As shown in FIGS. 6B and 6D, in the same manner as that mentioned above, a printing pattern P1 is formed as a result of the nozzles 61*a* to 68*a* and the nozzles 61*b* to 68*b* performing discharge of the ink 100 at the discharges of the $n^{th}$ time and the $n+2^{th}$ time. Further, as shown in FIGS. 6C and 6E, an adjusted pattern P2, in which, in addition to the nozzles 61*a* to 65*a* and the nozzles 61*b* to 65*b* of the overlapping section 6C, the discharge of the ink 100 is regulated in the nozzles 66*a* and 67*a*, and the nozzles 66*b* and 67*b* in the vicinity thereof, is formed at the discharges of the $n+1^{th}$ time and the $n+3^{th}$ time. As a result of this, in portions in which the first dots 100*a* and the second dots 100*b* overlap in FIGS. 5A to 5E, only one of the first nozzle row 6A and the second nozzle row 6B discharges the ink 100. Accordingly, as shown in FIGS. 6C to 6E, it is possible to prevent a circumstance in which the first dots 100*a* and the second dots 100*b* overlap on the work W. Further, by alternately forming the printing pattern P1 and the adjusted pattern P2 along the x axis direction, it is possible to prevent a deterioration in image quality in the image on the work W caused by overlapping of the first dots 100*a* and the second dots 100*b*, and therefore, it is possible to perform favorable printing.

In this instance, FIG. 7A is a plan view of the work W on which printing is performed by preventing overlapping of the first dots 100*a* and the second dots 100*b* in the above-mentioned manner. FIG. 7B is a view in which the printing in the manner of FIG. 7A is completed, and the work W is moved (a carriage return is performed). FIG. 7C is a view that shows a state in which a new image 300 is printed on a −y axis side of an image 200 formed in FIG. 7A. In FIG. 7B, the work W is moved, that is, a carriage return is performed, by an amount that is equivalent to the length $L_1$ along the y axis direction of the nozzle groups 6.

As can be understood from FIG. 7C, in the printing apparatus 1, if a carriage return is performed by an amount that is equivalent to the length of the nozzle groups 6, a blank space S is formed between an end section on the −y axis side of an image and an end section on the +y axis side of an image as a result of the above-mentioned shifting of the landing positions. A length along the y axis direction of a blank space S is an amount that is equivalent to two nozzles. As a result of this blank space S, there is a concern that a stripe is inserted in the image, and the image quality will be reduced as a result. In such an instance, in the printing apparatus 1, as shown in FIG. 8B, a carriage return amount $L_3$ is set to be shorter than the length $L_1$ shown in FIG. 7B by an amount that is equivalent to two nozzles. As a result of this, as shown in FIG. 8C, it is possible to close up a gap between the image 200 and the image 300 by an amount that is equivalent to two nozzles. Accordingly, it is possible to avoid a circumstance in which the blank space S is created.

In this manner, in the printing apparatus 1, it is possible to prevent formation of the blank space S that accompanies a carriage return, which is caused by shifting of the landing positions, while preventing overlapping of the first dots 100*a* and the second dots 100*b*, which is caused by shifting of the landing positions. As a result of the above-mentioned description, the printing apparatus 1 can perform favorable printing.

Additionally, the above-mentioned positional shift of the landing positions, that is, an extent of the overlapping of the first dots 100*a* and the second dots 100*b*, and an extent of the blank space S are accurately calculated by performing a test print in an empirical manner in advance, and the test results thereof are stored in the storage section 152.

In addition, since the first nozzle row 6A and the second nozzle row 6B discharge the same color of the ink 100, it is possible to obtain the effect of the invention more significantly.

Next, a control program of the printing apparatus 1 will be described on the basis of the flowchart that is shown in FIG. 9.

Firstly, the extent of the overlapping of the first dots 100*a* and the second dots 100*b*, and the extent of the blank space S are calculated by performing a test print prior to performing printing on the work W in the printing apparatus 1. Further, an operator inputs the overlapping extent (a number) into the printing apparatus 1 (Step S101).

In Step S102, as shown in FIGS. 6C and 6E, on the basis of the input information, nozzles which are not to discharge the ink 100 at the $n+1^{th}$ time and the $n+3^{th}$ time, are established, and a carriage return amount is also established.

In Step S103, printing is initiated with the conditions established in Step S102.

Further, in Step S104, it is determined whether or not printing is complete. If it is determined that printing is complete in Step S104, printing is finished. Additionally, if it is determined that printing is not complete in Step S104, printing is performed until it is determined that printing is complete.

Second Embodiment

Figure 10:
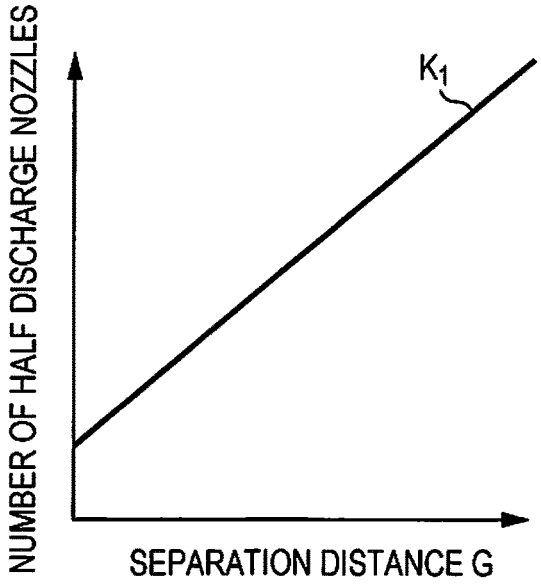
FIG. 10 is a graph that shows a calibration curve that is stored in a storage section of a second embodiment of the printing apparatus of the invention.
Figure 11:
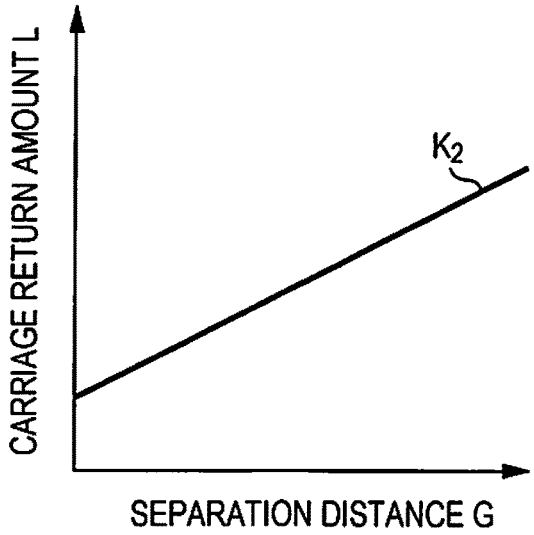
FIG. 11 is a graph that shows a calibration curve that is stored in a storage section of a second embodiment of the printing apparatus of the invention.

FIG. 10 is a graph that shows a calibration curve that is stored in a storage section of a second embodiment of the printing apparatus of the invention. FIG. 11 is a graph that shows a calibration curve that is stored in a storage section of a second embodiment of the printing apparatus of the invention.

Hereinafter, the second embodiment of the printing apparatus of the invention will be described with reference to the above-mentioned drawings, but description will be given focusing on the differences with the above-mentioned embodiment, and the description of like matters will be omitted.

Apart from the fact that a control program is different, the present embodiment is the same as the first embodiment.

Generally, the extent of the positional shift of the first dots 100*a* and the second dots 100*b* described in the first embodiment differs depending on the extent of the separation distance G.

In such an instance, in the present embodiment, nozzles (hereinafter, referred to as "half discharge nozzles") which are not to discharge the ink 100 at the discharge of the $n+1^{th}$ time and the discharge of the $n+3^{th}$ time, are established according to the separation distance G, and a carriage return amount L is computed according to the separation distance G. Hereinafter, this configuration will be described.

In the printing apparatus 1, as a result of detecting the separation distance G, and inputting the detected results, it is possible for the control section 15 to calculate a number of the half discharge nozzles and a carriage return amount on the basis of the input information, a calibration curve $K_1$ (refer to FIG. 10) and a calibration curve $K_2$ (refer to FIG. 11).

FIG. 10 is a graph in which the vertical axis is the number of half discharge nozzles, and the horizontal axis is the separation distance G. According to the calibration curve $K_1$ of the graph, it is possible to calculate the number of the half discharge nozzles by inputting the separation distance G.

FIG. 11 is a graph in which the vertical axis is the carriage return amount L, and the horizontal axis is the separation distance G. According to the calibration curve $K_2$ of the graph, it is possible to calculate the carriage return amount L by inputting the separation distance G.

In this manner, in the present embodiment, it is possible to calculate the number of the half discharge nozzles and the carriage return amount L according to the extent of the separation distance G.

Additionally, the test print is performed in advance in an empirical manner, and the calibration curves $K_1$ and $K_2$ are stored in the storage section 152 on the basis of the test results. For example, it is possible to calculate the half discharge nozzles while changing the separation distance G in an empirical manner, plot two points of data thereof, and set a straight line that connects each point as the calibration curve $K_1$. That is, it is possible to calculate the calibration curve $K_1$ from two items of empirical data by treating a relationship between the separation distance G and the half discharge nozzles as a proportional connection. The same also applies to the calibration curve $K_2$. According to such a method, it is possible to calculate the calibration curves $K_1$ and $K_2$ from comparatively little empirical data.

Embodiments of the drawings that show the printing apparatus and the printing method of the invention have been described above, but the invention is not limited to these embodiments, and it is possible to substitute each section that configures the printing apparatus for a section that has an arbitrary configuration that is capable of exhibiting the same function. In addition, arbitrary components may be added.

In addition, the printing apparatus of the invention may be a printing apparatus in which two or more arbitrary configurations (features) of each of the above-mentioned embodiments are combined.

In addition, in each of the above-mentioned embodiments, the adjustment of the separation distance between the recording medium and the nozzles is performed by raising the nozzles, but the invention is not limited to this configuration, and adjustment may be performed by raising the endless belt.

In addition, in each of the above-mentioned embodiments, in a case in which the length $L_1$ of the third printing region increases further beyond the length $L_2$ of the overlapping section 6C as the separation distance between the recording medium and the nozzles increases, is described, but the invention is not limited to this configuration, and a case in which the length $L_1$ of the third printing region decreases further below the length $L_2$ of the overlapping section 6C as the separation distance between the recording medium and the nozzles increases, may also be used.

In addition, in each of the above-mentioned embodiments, the printing pattern P1 and the adjusted pattern P2 are alternately formed along the x axis direction, but the invention is not limited to this configuration, and for example, the half discharge nozzles that correspond to the third printing region may be split into the first nozzle row and the second nozzle row using data for discharge control that uses a dither mask, or an inclined mask, in which a discharge ratio becomes smaller as at nozzle edge sections.

Application Example 1

According to an aspect of the embodiment, there is provided a printing apparatus including: a transport section that transports a recording medium; a printing section that is provided so as to be capable of moving in a direction that intersects a transport direction in which the transport section transports the recording medium, and that includes multiple nozzles which perform printing by discharging an ink, as liquid droplets, onto the recording medium transported by the transport section; and a control section that controls the actions of the transport section and the printing section, in which the printing section includes a first nozzle row, which is disposed so that each nozzle extends in the transport direction, and which forms a first printing region on the recording medium, a second nozzle row, in which each nozzle is arranged along the first nozzle row, and which forms a second printing region on the recording medium, and an overlapping section in which portions of the first nozzle row and the second nozzle row overlap when viewed from a direction that intersects the transport direction, a length along the transport direction of a third printing region is longer than a length along the transport direction of the overlapping section when portions among the first printing region and the second printing region, in which the overlapping section is formed, are set as the third printing region, and the control section prohibits overlapping of the first printing region with the second printing region on the recording medium when forming the third printing region.

In this case, it is possible to prevent a circumstance in which the first printing region and the second printing region overlap on the recording medium. Accordingly, it is possible to prevent a deterioration in the image quality of an obtained image.

Application Example 2

In the printing apparatus according to the aspect, it is preferable that the control section forms an adjusted pattern on the recording medium by regulating the discharge of liquid droplets of the nozzles of the overlapping section, and the nozzles among the first nozzle row and the second nozzle row, which are in the vicinity of the overlapping section.

In this case, it is possible to prevent a circumstance in which the first printing region and the second printing region overlap on the recording medium. Accordingly, it is possible to prevent a deterioration in the image quality of an obtained image.

Application Example 3

In the printing apparatus according to the aspect, it is preferable that the control section alternately forms a printing pattern with which the nozzles of the first nozzle row and the second nozzle row discharge the liquid droplets, and the adjusted pattern, along a movement direction of the printing section.

In this case, it is possible to prevent overlapping of the first printing region and the second printing region in all regions of an obtained image.

Application Example 4

In the printing apparatus according to the aspect, it is preferable that the printing is performed on the recording medium in advance in an empirical manner, and the nozzles that form the adjusted pattern are established on the basis of the results thereof.

In this case, it is possible to accurately recognize the portions in which the first printing region and the second printing region overlap.

Application Example 5

In the printing apparatus according to the aspect, it is preferable that the nozzles in which the discharge of the liquid droplets is regulated, are established depending on a separation distance between each nozzle and the recording medium that is directly below each nozzle.

In this case, it is possible to prevent a circumstance in which the first printing region and the second printing region overlap regardless of the separation distance.

Application Example 6

In the printing apparatus according to the aspect, it is preferable that the liquid droplets which the first nozzle row and the second nozzle row discharge, are the same color.

In this case, it is possible to further exhibit the effect of the embodiment.

Application Example 7

According to another aspect of the embodiment, there is provided a printing method that performs printing using a printing apparatus including a transport section that transports a recording medium, and a printing section that is provided so as to be capable of moving in a direction that intersects a transport direction in which the transport section transports the recording medium, and that includes multiple nozzles which perform printing by discharging an ink, as liquid droplets, onto the recording medium transported by the transport section, in which the printing section includes a first nozzle row, which is disposed so that each nozzle extends in the transport direction, and which forms a first printing region on the recording medium, a second nozzle row, in which each nozzle is arranged along the first nozzle row, and which forms a second printing region on the recording medium, and an overlapping section in which portions of the first nozzle row and the second nozzle row overlap when viewed from a direction that intersects the transport direction, a length along the transport direction of a third printing region is longer than a length along the transport direction of the overlapping section when portions among the first printing region and the second printing region, in which the overlapping section is formed, are set as a third printing region, and overlapping of the first printing region with the second printing region on the recording medium is prohibited when forming the third printing region.

In this case, it is possible to prevent a circumstance in which the first printing region and the second printing region overlap on the recording medium. Accordingly, it is possible to prevent a deterioration in the image quality of an obtained image.

What is claimed is:

1. A printing apparatus comprising:

a transport section configured to transport a recording medium in a transport direction;

a printing section configured to move in an intersecting direction that intersects the transport direction, the printing section including a first nozzle row and a second nozzle row each of which has a plurality of nozzles that are configured to perform printing by discharging an ink, as liquid droplets, to form dots onto the recording medium transported by the transport section, the first nozzle row and the second nozzle row forming an overlapping section in which the first nozzle row and the second nozzle row overlap each other as viewed in the intersecting direction, each of the first and second nozzle rows having at least one adjacent nozzle that is adjacent to the overlapping section; and a control section configured to control the transport section and the printing section, the control section being configured to control discharge of the adjacent nozzles of each of the first and second nozzle rows, such that while the control section controls the printing section to form the dots successively on an area, which corresponds to the adjacent nozzle of each of the first and second nozzle rows on the recording medium, in the intersecting direction, the control section is configured to control the adjacent nozzle of each of the first and second nozzle rows to discharge the liquid droplets, during an Nth discharge among a plurality of discharges that the first and second nozzle rows perform in one pass in which the printing section moves in the intersecting direction, the N being an integer of one or more, and while the control section controls the printing section to form the dots successively on the area, which corresponds to the adjacent nozzle of each of the first and second nozzle rows on the recording medium, in the intersecting direction, the control section is configured to control the adjacent nozzle of each of the first and second nozzle rows not to discharge the ink, during an N+1th discharge among the discharges.

2. The printing apparatus according to claim 1, wherein the control section is further configured to control a plurality of overlapping nozzles, which are positioned in the overlapping section, not to discharge the ink.

3. The printing apparatus according to claim 2, wherein the control section is further configured to control the overlapping nozzles to discharge the ink during the Nth discharge, and the control section is further configured to control the overlapping nozzles not to discharge the ink during the N+1 discharge.

4. The printing apparatus according to claim 1, wherein the adjacent nozzle of each of the first and second nozzle rows, which is controlled not to discharge the ink, is established in advance before the printing is performed on the recording medium.

5. The printing apparatus according to claim 1, wherein the adjacent nozzle of each of the first and second nozzle rows, which is controlled not to discharge the ink, is established depending on a separation distance between each nozzle and the recording medium that is directly below each nozzle.

6. The printing apparatus according to claim 1, wherein the liquid droplets which the first nozzle row and the second nozzle row discharge, are the same color.

7. A printing method comprising:

transporting a recording medium in a transport direction;

moving a printing section in an intersecting direction that intersects the transport direction;

printing by discharging an ink, as liquid droplets, to form dots onto the recording medium from the printing section while the recording medium is transported, the printing section including a first nozzle row and a second nozzle row each of which has a plurality of nozzles that are configured to perform printing by discharging the ink, as the liquid droplets, the first nozzle row and the second nozzle row forming an overlapping section in which the first nozzle row and the second nozzle row overlap each other as viewed in the intersecting direction, each of the first and second nozzle rows having at least one adjacent nozzle that is adjacent to the overlapping section; and controlling the transporting and the printing, the controlling including controlling discharge of the adjacent nozzles of each of the first and second nozzle rows, such that while the printing section is controlled to from the dots successively on an area, which corresponds to the adjacent nozzle of each of the first and second nozzle rows on the recording medium, in the intersecting direction, the adjacent nozzle of each of the first and second nozzle rows is controlled to discharge the liquid droplets, during an Nth discharge among a plurality of discharges that the first and second nozzle rows perform in one pass in which the printing section moves in the intersecting direction, the N being an integer of one or more, while the printing section is controlled to form the dots successively on the area, which corresponds to the adjacent nozzle of each of the first and second nozzle rows on the recording medium, in the intersecting direction, the adjacent nozzle of each of the first and second nozzle rows is controlled not to discharge the ink, during an N+1th discharge among the discharges.

* * * * *